US006808421B2

(12) United States Patent
Okada et al.

(10) Patent No.: US 6,808,421 B2
(45) Date of Patent: Oct. 26, 2004

(54) CONNECTOR APPARATUS

(75) Inventors: Akira Okada, Shinagawa (JP); Satoshi Moriyama, Shinagawa (JP); Manabu Shimizu, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/404,080

(22) Filed: Apr. 2, 2003

(65) Prior Publication Data

US 2004/0043661 A1 Mar. 4, 2004

(30) Foreign Application Priority Data

Aug. 28, 2002 (JP) ..... 2002-248062

(51) Int. Cl.[7] ..... H01R 13/648
(52) U.S. Cl. ..... 439/608
(58) Field of Search ..... 439/608, 108, 439/101, 701, 79

(56) References Cited

U.S. PATENT DOCUMENTS

| | | | | |
|---|---|---|---|---|
| 5,980,321 A | | 11/1999 | Cohen et al. | |
| 6,146,202 A | * | 11/2000 | Ramey et al. | 439/608 |
| 6,343,955 B2 | * | 2/2002 | Billman et al. | 439/608 |
| 6,364,710 B1 | * | 4/2002 | Billman et al. | 439/608 |
| 6,371,813 B2 | * | 4/2002 | Ramey et al. | 439/608 |
| 6,431,914 B1 | * | 8/2002 | Billman | 439/608 |
| 6,506,076 B2 | * | 1/2003 | Cohen et al. | 439/608 |
| 6,527,587 B1 | * | 3/2003 | Ortega et al. | 439/608 |
| 6,540,522 B2 | * | 4/2003 | Sipe | 439/61 |

FOREIGN PATENT DOCUMENTS

| | | |
|---|---|---|
| JP | 5-275139 | 10/1993 |
| JP | 7-169531 | 7/1995 |
| JP | 8-236216 | 9/1996 |

* cited by examiner

*Primary Examiner*—Gary Paumen
(74) *Attorney, Agent, or Firm*—Staas & Halsey LLP

(57) ABSTRACT

A first connector includes a first connector body; first contacts provided in an end face of the first connector body in a matrix-like manner, each of the first contacts having a first contact point; and first shield plates provided between adjacent first contact points of the first contacts in a row direction, the first shield plates extending in a column direction of the first contact points, and shielding at least the adjacent first contact points in each row. A second connector includes a second connector body; second contacts provided in an end face of the second connector body in a matrix-like manner, each of the second contacts having a second contact point, the second contact points making contact with and being electrically connected to the first contact points; and second shield plates provided between adjacent second contact points of the second contacts in a column direction, the second shield plates extending in a row direction of the second contact points and shielding at least the adjacent second contact points in each column. At least one of the first and second shield plates are formed with slits receiving ends of the other one of the first and second shield plates. The first and second shield plates are configured and arranged to be engaged in a grid pattern by connecting the first and second connectors so that a contact part including the first and second contact points is arranged within one element defined by the grid pattern.

5 Claims, 13 Drawing Sheets

CONNECTOR APPARATUS

BACKGROUND OF THE INVENTION

1. Field of the Invention

The present invention generally relates to so-called two piece type connector apparatuses that electrically connect two circuit boards, for example, and more particularly, to shield structures of contacts that are electrically connected.

2. Description of the Related Art

Connectors are widely used as apparatuses that electrically connect electronic devices, such as computers, servers, switching equipment, and large computers.

When transmitting electronic signals at a high speed in the electronic apparatuses, there are problems such as crosstalk noise. Especially, in a back plane such as each module of a computer, a logic module and a memory module, for example, and a circuit board used for performing necessary connections among other circuit boards plugged therein at right angles, it is important to positively match transmission characteristics of high-speed electronic signals.

Hence, for connectors used for connections of the back plane, a balanced transmission technique that performs differential signal transmission capable of canceling out noise that might be generated in transmission of high frequency signals is adopted. Additionally, in order to positively reduce crosstalk noise, a coaxial structure that covers, for example, the outsides of a plurality of signal lines with shield members is adopted, and shield terminals and ground terminals are provided between adjacent signal contact points.

A description will be given of an example of such conventional connectors, with reference to FIGS. 1 through 9.

This conventional connector is a so-called two piece type connector used by connecting a pair of connectors and includes a plug connector shown in FIGS. 1 through 3 and a jack connector shown in FIGS. 4 through 7. The two piece type connector (connector apparatus) is used for balanced transmission.

First, a description will be given of the plug connector. FIG. 1 is a perspective view of the plug connector, FIG. 2 is a diagram of the plug connector seen from the direction indicated by "a" in FIG. 1, and FIG. 3 is a diagram of the plug connector seen from the direction indicated by "b" in FIG. 1.

In a plug connector 1, a housing 2 is formed into a shape including a vertical wall 2*a* and horizontal walls 2*b* and 2*c*. The horizontal walls 2*b* and 2*c* are provided at opposing up and down sides of the vertical wall 2*a* so as to interpose the vertical wall 2*a* therebetween. In addition, a plurality of plug contacts 3 having substantially bar shapes and passing through the vertical wall 2*a* are arranged in a matrix-like manner when seen from an end face of the vertical wall 2*a*. Two plug contacts 3 (denoted by reference numerals 3A and 3B in FIG. 3) arranged side-by-side up and down, that is, in the same column, transmit in pairs signals having symmetrical positive and negative waveforms.

Each of the contacts 3 includes contact points 3*a* and 3*b* at opposing ends. The contact point 3*a* is for making contact with and electrically connecting to a contact point of the jack connector, which will be described later. The contact point 3*b* is for engaging with and electrically connecting to a throughhole in a board (not shown).

Considering the two contact points 3*a* of a pair of plug contacts 3 (3A and 3B) as one unit, an angle-like (L-shaped at cross section) shield plate 4 is provided for each unit by covering two sides thereof.

Next, a description will be given of the jack connector. FIG. 4 is a perspective view of the jack connector, FIG. 5 is a diagram of the jack connector as seen from the direction indicated by "c" in FIG. 4, FIG. 6 is a diagram showing contacts removed from the jack connector in FIG. 5, and FIG. 7 is a diagram of the jack connector seen from the direction indicated by "d" in FIG. 4.

In a jack connector 5, a housing 6 is formed into a shape where horizontal walls 6*b* and 6*c* are extending from opposing up and down sides of a vertical wall-like main body 6*a*.

A jack contact 7 is formed into an angle-like shape and includes contact points 7*a* and 7*b* at the opposing ends. The contact point 7*a* is for making contact with and electrically connecting to the contact point 3*a* of the plug connector 1 and is formed to be biforked. On the other hand, the contact point 7*b* is for engaging with and electrically connecting to a throughhole in a board (not shown) and is formed into a press fit-like shape. Four pairs of contacts 7A and 7B having different shapes are arranged in a column direction and integrally molded into a resin part 7*c*. A plurality of the jack contacts 7 are arranged in a matrix-like manner when seen from an end face of the main body 6*a*. The jack contacts 7 are used for transmitting signals having symmetrical positive and negative waveforms by pairing two adjacent up and down (in the same column) jack contacts 7 (denoted by reference numerals 7A and 7B in FIG. 7).

Considering the two contact points 7*a* of a pair of the jack contacts (7A and 7B) as one unit, a shield plate 8 having a tongue-shaped part 8*a* on one side is provided for each unit. The shield plate 8 is arranged in parallel with the jack contacts 7 in the column direction (vertical direction). Pin parts 8*b* located on the opposite side of the tongue-shaped parts 8*a* protrude from a bottom-side end face of the resin part 7*c* in FIG. 4.

As shown in FIG. 8, the plug connector 1 and the jack connector 5 are in contact with and electrically connected to each other such that the contacts 3*a* of the plug contacts 3 are supported by the biforked contact points 7*a* of the jack contacts 7.

As shown in FIG. 9, in a state where the contact points 3*a* and the contact points 7*a* are in contact, three sides of a pair of contact parts (one unit) 9 in each of which the contact point 3*a* and the contact point 7*a* are in contact are covered with the shield plate 4 and the tongue-shaped part 8*a* of the shield plate 8. In addition, one side (the lower side in FIG. 9) that is not covered with the shield plates 4 and 8 is shielded by the adjacent shield plate 4 from the downside adjacent pair of the contact parts (one unit) 9 in the column. Hence, each of the pairs of the contact parts (one unit) 9 arranged in a matrix-like manner is shielded by the shield plates 4 and 8 from adjacent pairs of the contact parts (one unit) 9 in each direction of the matrix. Accordingly, crosstalk generated between adjacent pairs of the contact parts (one unit) 9 arranged closely is reduced.

However, in the above-described conventional connector, the angle-shaped shield plate 4 of the plug connector 1 is provided for each pair of the contact parts (one unit) 9. For this reason, the number of components is large, thus resulting in a lot of assembly processes and high assembly cost.

Also, in the conventional connector, because of its structure, the surroundings (four sides) of one pair of the contact parts (one unit) 9 are not always shielded sufficiently.

SUMMARY OF THE INVENTION

It is a general object of the present invention to provide an improved and useful connector apparatus in which the above-mentioned problems are eliminated.

It is another and more specific object of the present invention to provide a connector apparatus that can preferably realize a shield structure capable of reducing crosstalk with a small number of components, and thus with a small number of assembly processes, and also with low assembly cost.

In order to achieve the above-mentioned objects, according to one aspect of the present invention, there is provided a connector apparatus that includes: a first connector; and a second connector connected to the first connector, the first connector including: a first connector body; a plurality of first contacts provided in an end face of the first connector body in a matrix-like manner, each of the first contacts having a first contact point; and a plurality of first shield plates provided between adjacent first contact points of the first contacts in a row direction, extending in a column direction of the first contact points of the first contacts, and shielding at least the adjacent first contact points in each row, the second connector including: a second connector body; a plurality of second contacts provided in an end face of the second connector body in a matrix-like manner, each of the second contacts having a second contact point, the second contact points making contact with and being electrically connected to the first contact points; and a plurality of second shield plates provided between adjacent second contact points of the second contacts in a column direction, extending in a row direction of the second contact points of the second contacts and shielding at least the adjacent second contact points in each column, wherein at least one of the first and second shield plates are formed with slits receiving ends of the other one of the first and second shield plates, and the first and second shield plates are configured and arranged to be engaged in a grid pattern by connecting the first and second connectors so that a contact part including the first and second contact points is arranged within one element defined by the grid pattern.

According to the above-mentioned aspect of the present invention, when connecting two circuit boards, for example, it is possible to realize a shield structure capable of preferably reducing crosstalk with a small number of components, thus with a small number of processes and low assembly cost. In addition, for this reason, compared with the case where balanced transmission is performed by using a pair of contacts, it is possible to make mounting density of the contacts of the connector higher.

In the above-described connector apparatus, the two first contact points of a pair of the adjacent first contacts in a row may form a first unit, and the first connector may include the first shield plates each extending in the column direction and shielding the adjacent first units in the column direction, the two second contact points of a pair of the adjacent second contacts in a row may form a second unit, and the second connector may include the second shield plates each extending in the row direction and shielding the adjacent second units in the column direction, and the first and second shield plates may be configured and arranged to be engaged in a grid pattern by connecting the first and second connectors, and two contact parts forming one unit and each including the first and second contact points may be arranged within one element defined by the grid pattern.

Accordingly, since high-speed signals are transmitted by a balanced transmission method, it is possible to preferably reduce crosstalk.

Also, the first and second contact points may fit in to and make contact with each other.

The connector apparatus having the above-described structure is preferable since it is possible to positively establish electrical connection.

In addition, the ends of one of the first and second shield plates may be formed into pin-like shapes, the ends of the other one of the first and second shield plates may be formed into biforked shapes, and both ends may fit in to and engage each other.

The connector apparatus having the above-described structure is preferable since it is possible to more positively connect the first and second shield plates.

Further, one of the first and second connectors may be provided with third contact points in the corresponding one of the first and second contacts, the third contact points protruding from an end face perpendicular to the end face of the corresponding one of the first and second connector bodies, and the other one of the first and second connectors may be provided with fourth contact points in the other one of the first and second contacts, the fourth contact points protruding from an end face parallel to the end face of the other one of the first and second connector bodies.

With the connector apparatus having the above-described structure, it is possible to preferably and electrically connect two circuit boards arranged such that both principal surfaces are perpendicular to each other.

Additionally, the first and second shield plates may be formed to cover the entire first and second contacts each including one of the third and fourth contact points, respectively.

With the connector apparatus having the above-described structure, it is possible to more preferably reduce crosstalk noise.

Other objects, features and advantages of the present invention will become more apparent from the following detailed description when read in conjunction with the following drawings.

DETAILED DESCRIPTION OF THE PREFERRED EMBODIMENTS

Referring to FIGS. 10 through 18, a description will be given of a preferred embodiment of the connector apparatus according to the present invention.

Figure 1:
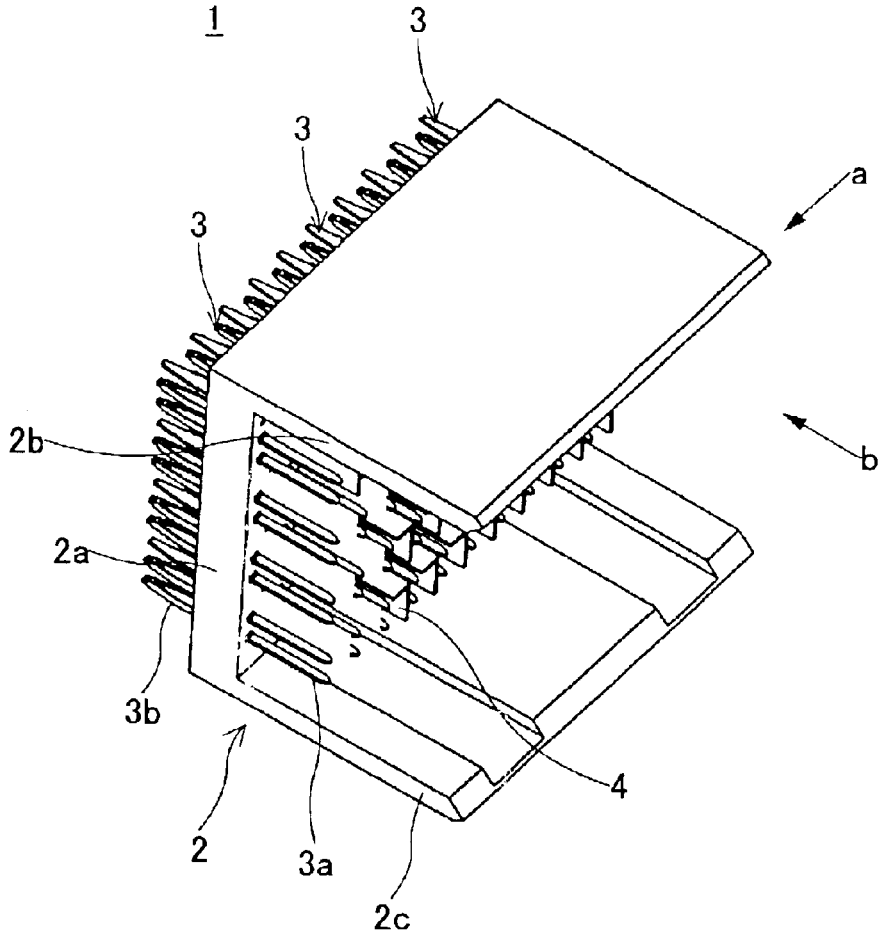
FIG. 1 is a perspective view of a conventional plug connector.
Figure 2:
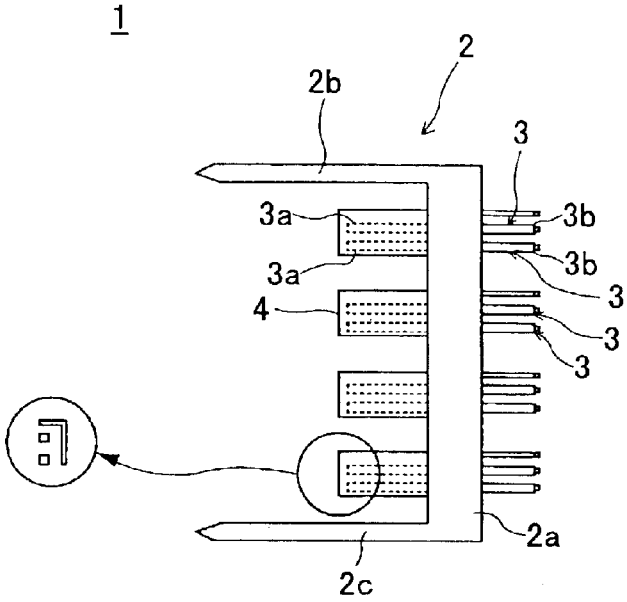
FIG. 2 is a side elevation view of the plug connector seen from the direction indicated by an arrow a in FIG. 1.
Figure 3:
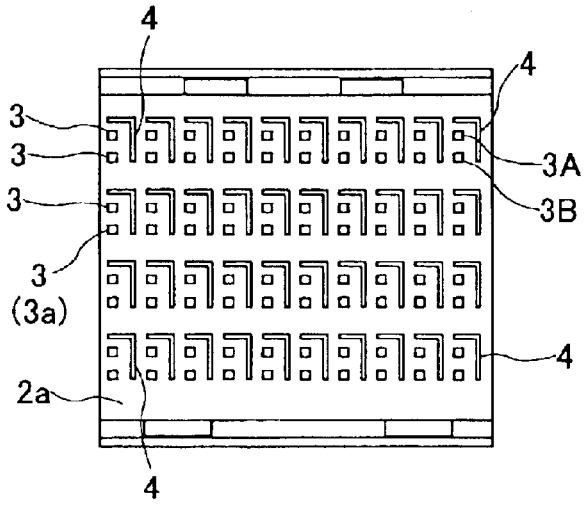
FIG. 3 is a front elevation view of the plug connector seen from the direction indicated by an arrow b in FIG. 1.
Figure 4:
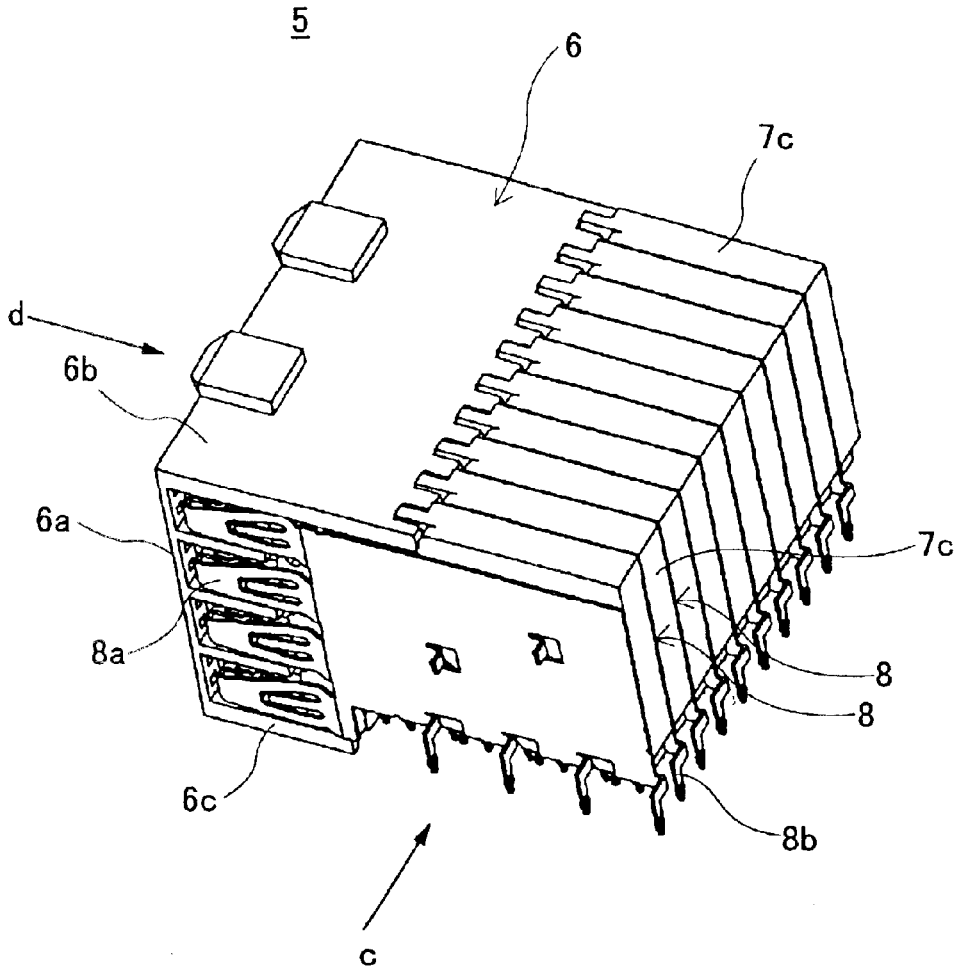
FIG. 4 is a perspective view of a conventional jack connector.
Figure 5:
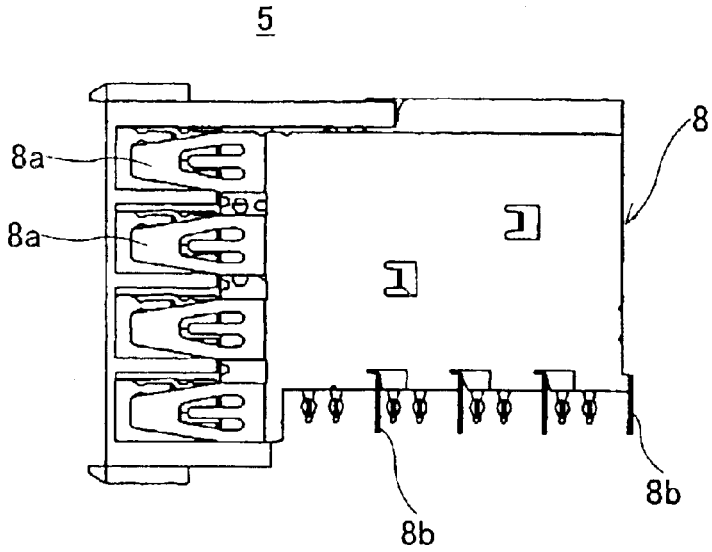
FIG. 5 is a side elevation view of the jack connector seen from the direction indicated by an arrow c in FIG. 4.
Figure 6:
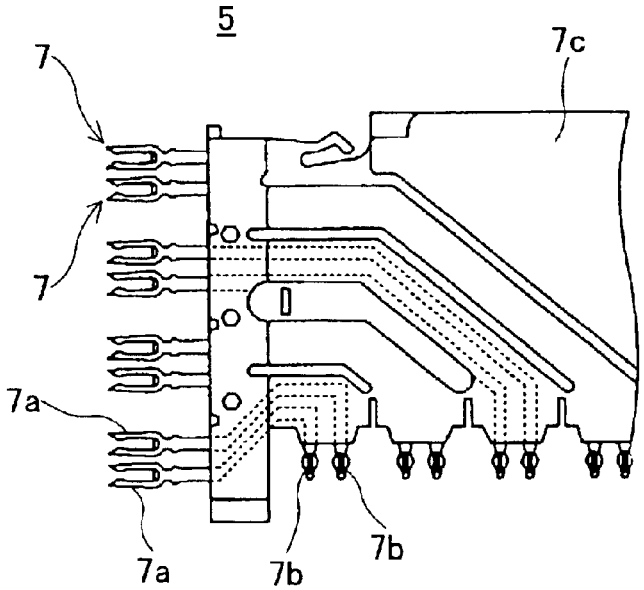
FIG. 6 is a schematic diagram showing eight contacts integrated by a resin part in the jack connector shown in FIG. 4.
Figure 7:
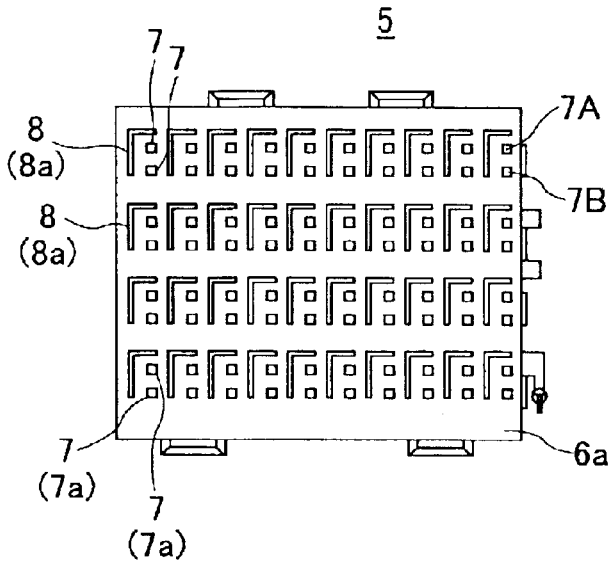
FIG. 7 is a front elevation view of the jack connector seen from the direction indicated by an arrow d in FIG. 4.
Figure 8:
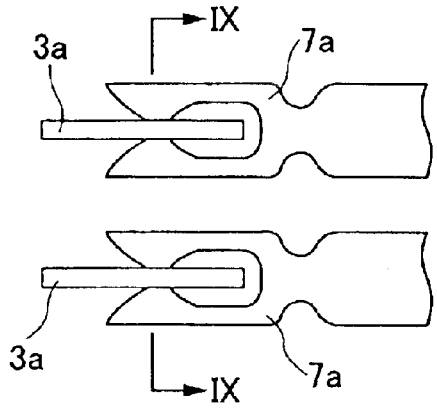
FIG. 8 is a schematic diagram for explaining a contact state of contact points when the conventional plug connector and jack connector are connected.
Figure 9:
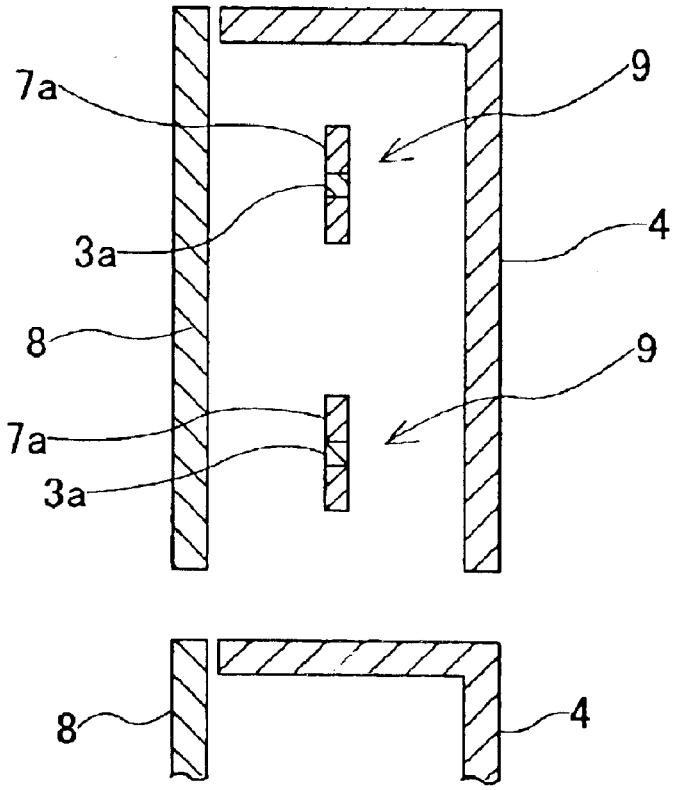
FIG. 9 is a schematic diagram for explaining the arrangement and relationships among the contact points and shield plates when the conventional plug connector and jack connector are connected.
Figure 10:
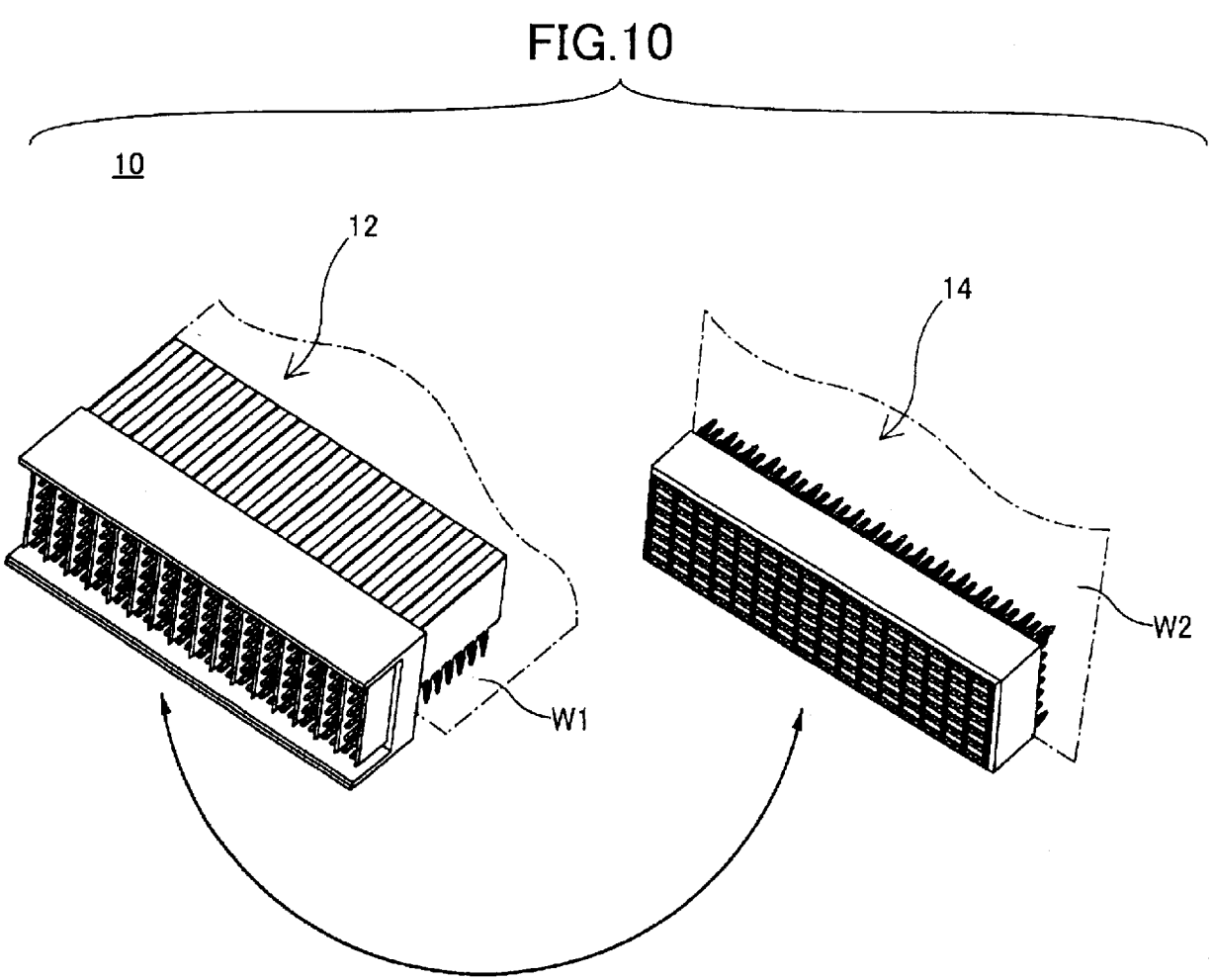
FIG. 10 is a perspective view of a plug connector and a jack connector of a connector apparatus according to one embodiment of the present invention.
Figure 11:
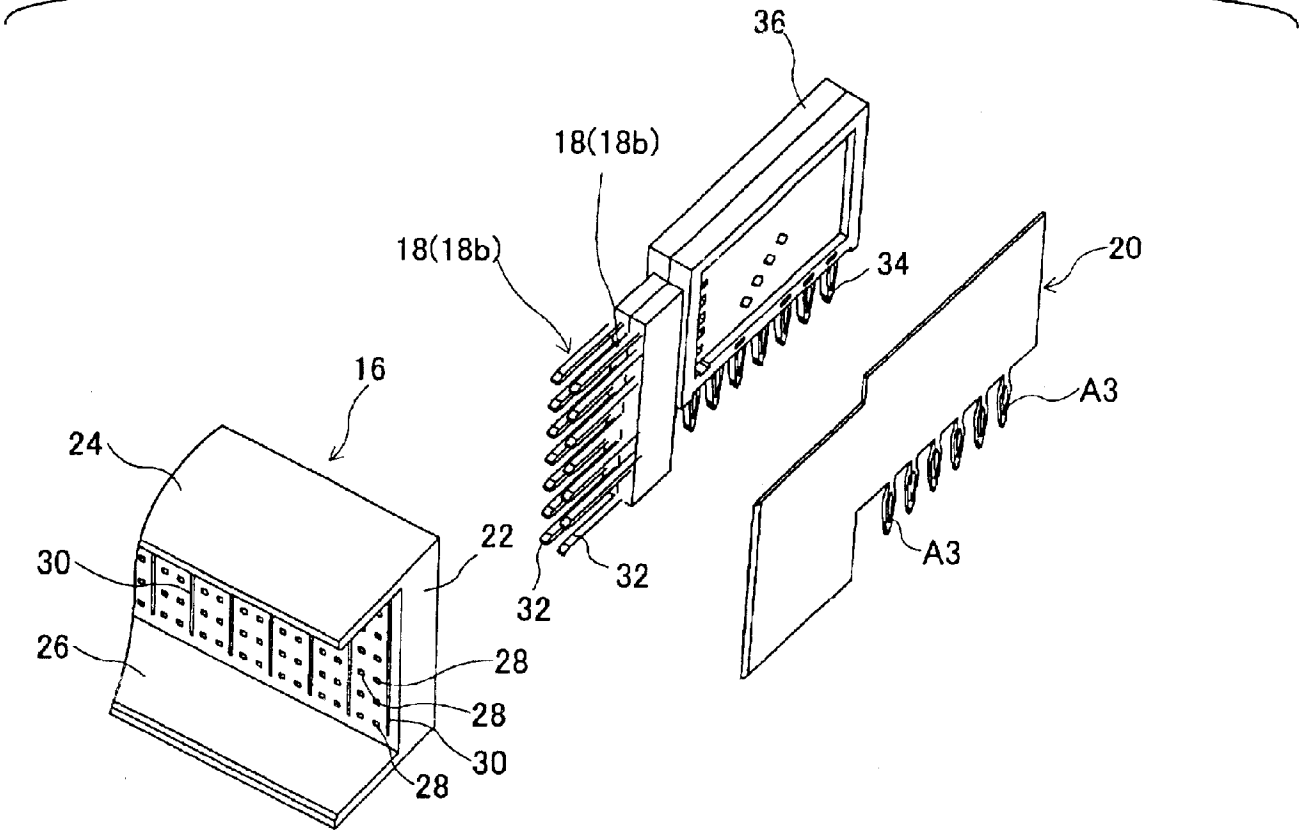
FIG. 11 is an exploded perspective view of the plug connector of the connector apparatus according to the embodiment with some parts eliminated.
Figure 12:
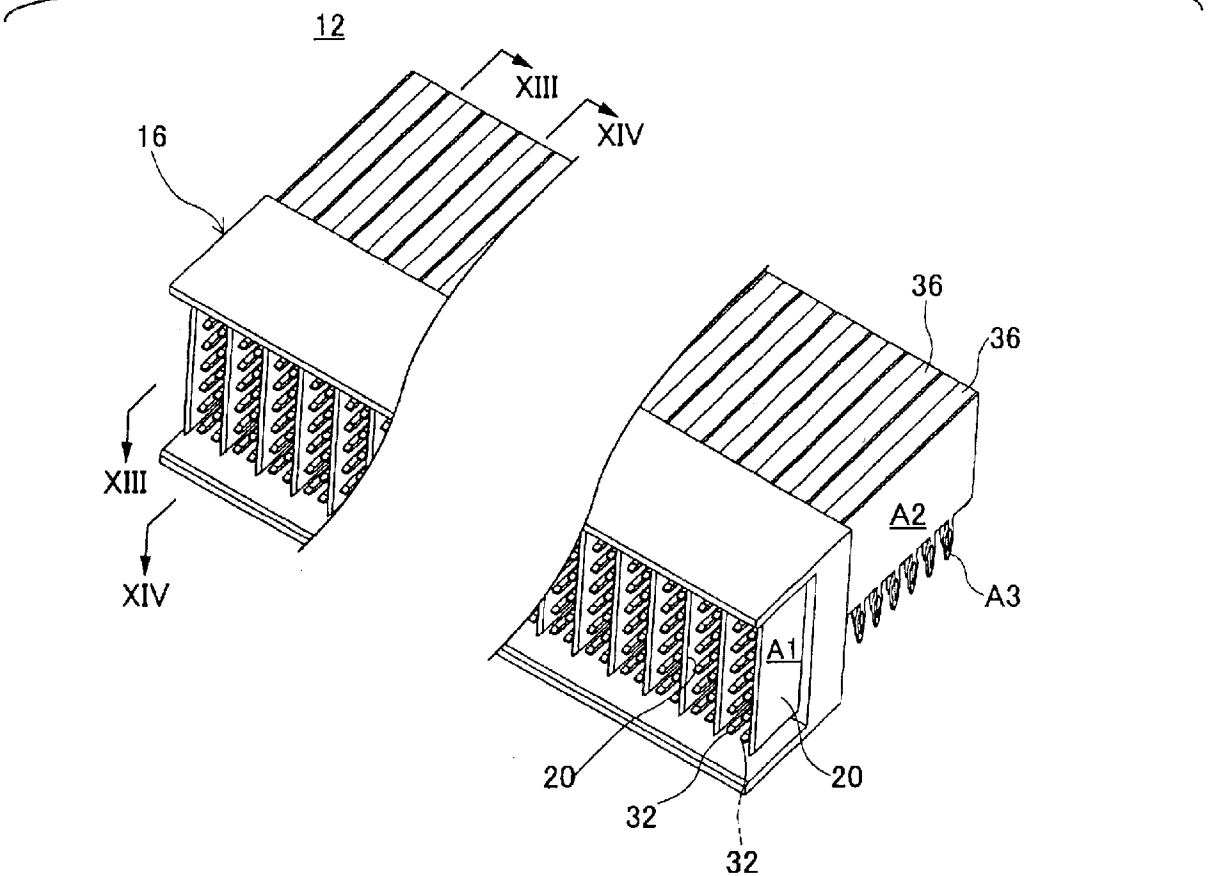
FIG. 12 is a perspective view of the plug connector of the connector apparatus according to the embodiment with some parts eliminated.
Figure 13:
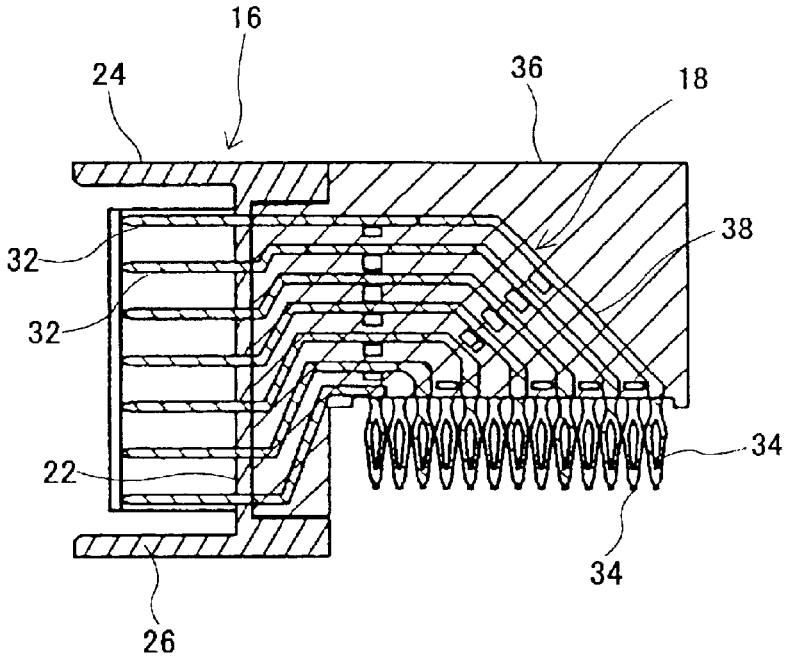
FIG. 13 is a cross-sectional view of the plug connector of the connector apparatus according to the embodiment taken along line XIII—XIII in FIG. 12.
Figure 14:
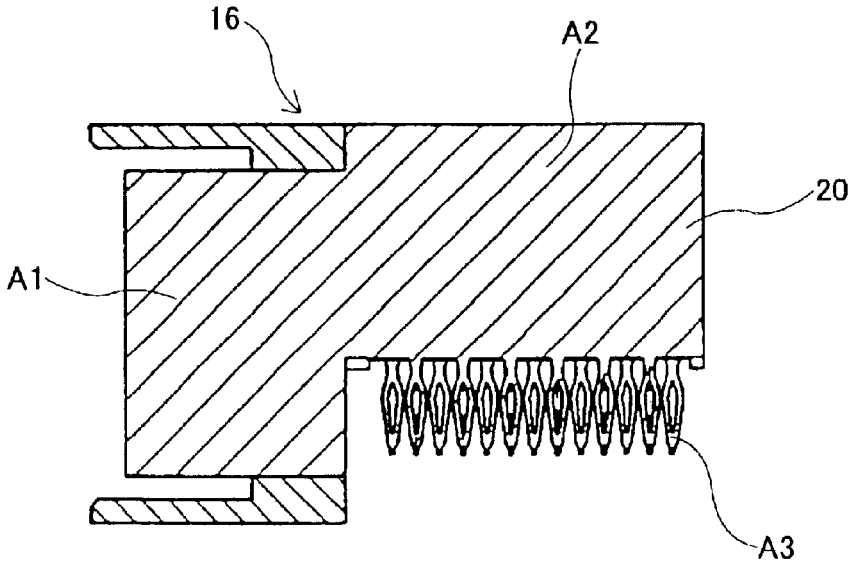
FIG. 14 is a cross-sectional view of the plug connector of the connector apparatus according to the embodiment taken along line XIV—XIV in FIG. 12.
Figure 15:
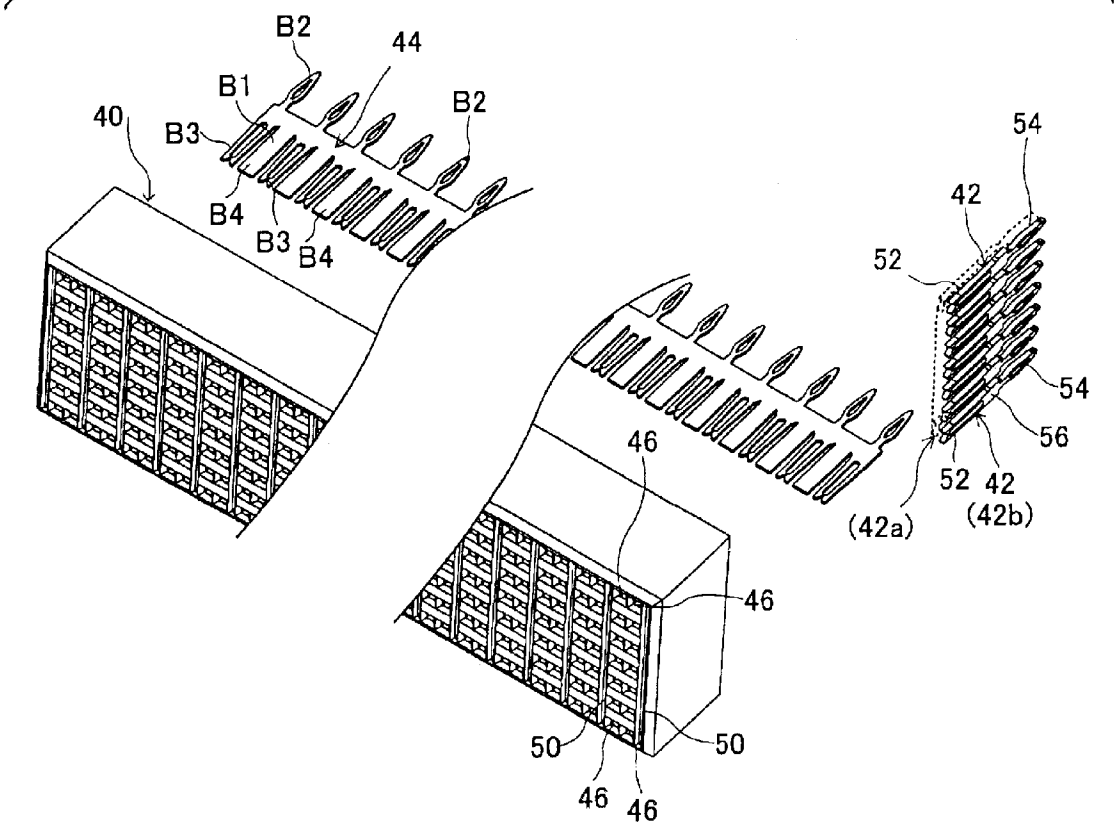
FIG. 15 is an exploded perspective view of the jack connector of the connector apparatus according to the embodiment with some parts eliminated.
Figure 16:
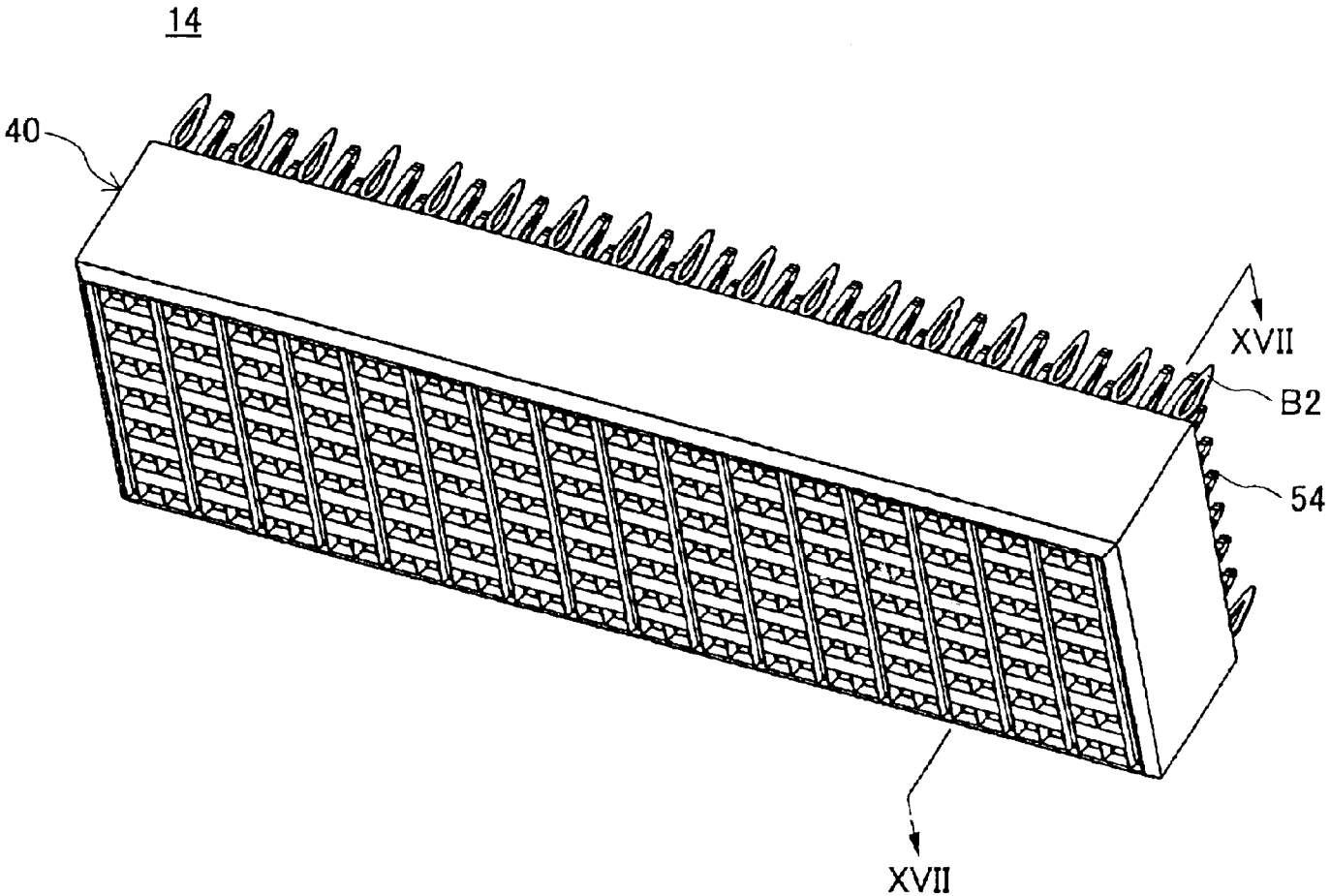
FIG. 16 a perspective view of the jack connector of the connector apparatus according to the embodiment.
Figure 17:
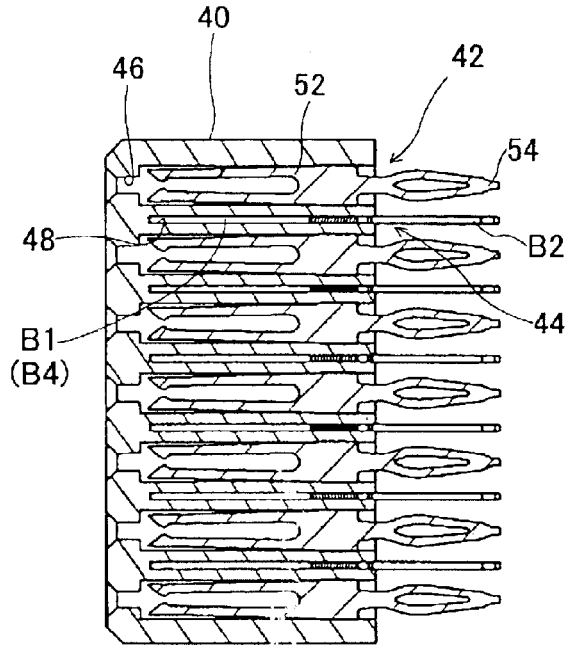
FIG. 17 is a cross-sectional view of the jack connector of the connector apparatus according to the embodiment taken along line XVII—XVII in FIG. 16.
Figure 18:
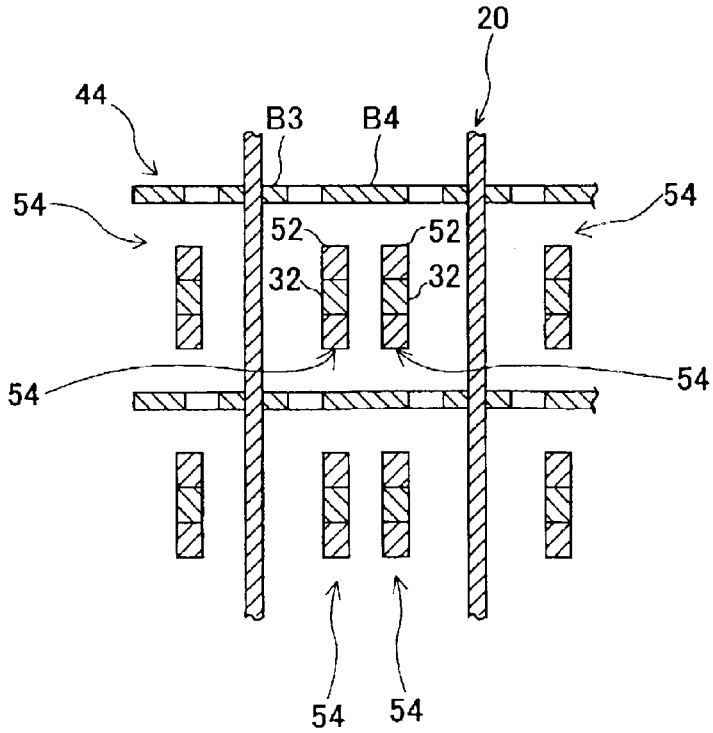
FIG. 18 is a schematic diagram for explaining the arrangement relationship among contact points and shield plates when the plug connector and jack connector according to the embodiment are connected.

FIG. 10 is a perspective view of two connectors constructing the connector apparatus. FIG. 11 is an exploded perspective view of a plug connector with some parts eliminated. FIG. 12 is a perspective view of the plug connector with some parts eliminated. FIG. 13 is a cross-sectional view of the plug connector taken along line XIII—XIII in FIG. 12. FIG. 14 is a cross-sectional view of the plug connector taken along line XIV—XIV in FIG. 12. FIG. 15 is an exploded perspective view of a jack connector with some parts eliminated. FIG. 16 is a perspective view of the jack connector. FIG. 17 is a cross-sectional view of the jack connector taken along line XVII—XVII in FIG. 16. FIG. 18 is a schematic diagram showing a contact state of respective contact points when the plug connector and the jack connector are connected and arrangement relationship among the contact points and shield plates.

A connector apparatus 10 according to this embodiment is of a so-called two piece type used by connecting a pair of connectors, which is similar to the conventional example described above, and is constructed by a plug connector 12 and a jack connector 14. The plug connector 12 and the jack connector 14 are connected in the directions indicated by arrows in FIG. 10. The connector apparatus 10 according to this embodiment is used for balanced transmission.

First, a description will be given of the plug connector 12.

The plug connector 12 includes a housing 16, a plurality of contacts 18, and a plurality of shield plates 20.

In FIG. 11, the housing 16 includes a vertical wall-like main body 22 and horizontal walls 24 and 26 extending from both up and down sides of the main body 22 in an opposing manner. In the main body 22, a large number of holes 28 are formed in a matrix-like manner, and slits 30 extending in the column direction (vertical direction) are also formed for every two holes 28 in the row direction (lateral direction).

Contacts 18 are formed into substantially right angle shapes, each including a pin-like contact point 32 on one end and a press fit-like contact point 34 on the other end (refer to FIG. 13). The contact point 32 is for making contact with and electrically connecting to a contact point 52 of the jack connector 14, which will be described later. The contact point 34 is for engaging with and electrically connecting to a throughhole (not shown) in a board W1 arranged horizontally shown in FIG. 10.

Depending on the arrangement locations in the housing 16, the plurality of contacts 18 are different in the specific shapes and lengths of connecting parts (mounting parts of the contacts) that connect the contact points 32 and the contact points 34. That is, the contacts 18 located on the lower side are with the connecting parts 38 having short lengths. The connecting parts 38 of the contacts 18 located on the upper side are formed such that the further up the contact 18 is located, the longer the length of the connecting part 38 becomes. Also, the adjacent up and down (column direction) contacts 18 are formed to have different shapes in the up and down directions so that the contacts 18 do not contact each other in resin parts 36. On the other hand, the contacts 18 located at the same height (row direction) are formed with the same shape.

Two adjacent contacts 18 (denoted by reference numerals 18*a* and 18*b*) in the row direction are used in pairs for transmitting signals having symmetrical positive and negative waveforms.

In this embodiment, seven pairs of the contacts 18*a* and 18*b* are arranged in the column direction, and the seven pairs of the contacts 18*a* and 18*b* are molded and integrated in one substantially rectangular solid-like resin part 36. A connector body of the plug connector 12 is constructed by the resin parts 36 and the housing 16.

The shield plate 20 is formed into a substantially rectangular plate shape that substantially corresponds to the projection plane of the resin part 36 and the seven pairs of the contacts 18*a* and 18*b*. That is, the shield plate 20 includes a rectangular part A1 having the size enough to cover the contact points of seven pairs of the contacts 18*a* and 18*b* and a rectangular part A2 having the size enough to cover the resin part 36. Further, the shield plate 20 is formed into a shape where a plurality of press fit-like pins A3 extend downward from the rectangular part A2 so as to cover the contact points 34.

The contacts 18 are mounted to and integrated into the housing 16 such that the contact points 32 of the contacts 18 mounted to the resin part 36 are fit into and further inserted into the holes 28. In addition, the shield plate 20 is mounted to and integrated into the housing 16 such that the end of the rectangular part A1 is fit into and further inserted into the slit 30 of the housing 16. Here, it may be said that the resin parts 36 form a part of the housing 16.

When assembled, the pairs of the contacts 18*a* and 18*b* extend from the principal surface (end face of the housing 16) of the main body 22 of the housing 16 and are arranged in a matrix-like manner. Also, the contact points 34 extend from an end face of the resin part 36 in the direction perpendicular to the principal surface of the main body 22 and are arranged in a matrix-like manner.

In the plug connector 12 constructed as described above, seven pairs of the contacts 18*a* and 18*b* arranged in the column direction are shielded from seven pairs of the contacts 18*a* and 18*b* that are arranged in the column direction and adjacent in the row direction by the shield plate 20 in all the parts of the contact points 32, connecting parts 38 and contact points 34. Hence, it is possible to reduce crosstalk between pairs of the contacts 18*a* and 18*b* that are adjacent in the row direction. For this reason, it is also possible to make mounting density of the contacts 18 higher.

In the plug connector 12, the seven pairs of the contacts 18*a* and 18*b* arranged in the column direction are shielded from the adjacent seven pairs of the contacts 18*a* and 18*b* arranged in the column direction by one substantially rectangular shield plate 20. Thus, compared with such as the conventional plug connector 1 where each pair of the contacts 3*a* and 3*b* is shielded by one shield plate 4, the number of the shields is less. Therefore, it is possible to manufacture the plug connector 12 inexpensively with a small number of assembly processes.

Further, as described above, in the plug connector 12, a pair of the contacts 18*a* and 18*b* that are adjacent right and left (in the row direction) transmit in pairs the signals having symmetrical positive and negative waveforms, and the pair of the contacts 18*a* and 18*b* are formed into the same shapes. Accordingly, unlike the conventional example where adjacent up and down contacts having different shapes are paired up, propagation delay times of signals of the pair of the contacts 18*a* and 18*b* are the same. Thus, the plug connector 12 is preferable.

Further, when the plug connector 12 is used for single transmission, a shield plate may be provided between the contacts in each row. In this case, it is possible to make the mounting density of the contacts even higher.

Next, a description will be given of the jack connector 14.

The jack connector 14 includes a housing 40, a plurality of contacts 42 and a plurality of shield plates 44.

The housing 40 is formed into a rectangular solid-like shape, a plurality of holes 46 are formed therein in a matrix-like manner, and slits 48 extending in the row direction (lateral direction) are formed between holes 46 in the column direction (longitudinal direction) (Refer to FIG. 17. The slits 48 are not shown in FIG. 15). In addition, slits 50 extending in the column direction (longitudinal direction) are formed every two holes 46 in the row direction (lateral direction).

Each of the contacts 42 is formed into a substantially straight shape and includes a biforked contact point 52 at one end and a press fit-like contact point 54 at the other end. The contact point 52 is for making contact with and electrically connecting to the contact point 32 of the contact 18. The contact point 54 is for engaging with and electrically connecting to a throughhole (not shown) in a board W2 arranged perpendicularly and shown in FIG. 10. The plurality of contacts 42 are all formed into the same shape.

Seven contacts 42 are attached to and integrated into a resin part 56 in the up and down directions in FIG. 15. By arranging the seven contacts 42 attached to the resin part 56 in rows of two, seven pairs of the contacts 42*a* and 42*b*, where contacts 42*a* and 42*b* of a pair are adjacent in the row direction (lateral direction), are arranged in the column direction (longitudinal direction). Each of the pairs of the contacts 42*a* and 42*b* are used for transmitting signals having symmetrical positive and negative waveforms. A connector body of the jack connector 14 is constructed by the resin parts 56 and the housing 40.

In the shield plate 44, a plurality of press fit-like pins B2 are arranged on one side of a substantially rectangular principal surface B1. The principal surface B1 is notched by leaving rectangular parts B4 with a constant pitch and formed into a plurality of biforked parts B3. In this case, as described later, the biforked parts B3 are for receiving the ends of the shield plates 20, so to speak, the biforked parts B3 acting as a form of slit. In this case, literally thin groove-like slits may be formed instead of the biforked parts B3.

The contacts 42 are mounted to and integrated into the housing 40 by fitting the contact points 52 of the contacts 42 into the holes 46 of the housing 40. Additionally, the shield plates 44 are mounted to and integrated into the housing 40 by fitting the principal surfaces B1 of the shield plates 44 into the slits 48.

When assembled, regarding the pairs of the contacts 42*a* and 42*b*, the contact points 52 are arranged in the holes 46 of the housing 40 in a matrix-like manner, and the contact points 54 extend from the principal surface (end face) of the housing 40 and are arranged in a matrix-like manner.

In the jack connector 14 constructed as described above, a plurality of pairs of the contacts 42*a* and 42*b* arranged in the row direction are shielded, in the parts of the contact points 52, by the shield plate 44 from a plurality of pairs of the contacts 42*a* and 42*b* that are arranged in the row direction and adjacent in the column direction. Hence, it is possible to reduce crosstalk between adjacent pairs of the contacts 42*a* and 42*b* in the column direction. Further, for this reason, it is also possible to make the mounting density of the contacts higher.

In the jack connector 14, a plurality of pairs of the contacts 42*a* and 42*b* arranged in the column direction are shielded by one shield plate 20 formed into a substantially rectangular shape. Thus, compared with the case where the pairs of the contacts 3*a* and 3*b* are shielded by one of the plurality of tongue-shaped parts 8*a* provided to one shield plate 8 as in the jack connector 5 of the conventional example, the shape of the shield plate is simpler. Hence, it is possible to manufacture the jack connector 14 inexpensively.

Further, when the jack connector 14 is used for single transmission, a shield plate may be provided between contacts in each row. In this case, it is possible to make the mounting density of the contacts even higher.

As in the conventional example, in the connector apparatus 10 according to this embodiment constructed as described above, the contact points 32 of the contacts (plug contacts) 18 of the plug connector 12 are supported by the biforked contact points 52 of the contacts (jack contacts) 42 of the jack connector 14 so as to make contact and establish electrical connection.

On this occasion, the rectangular parts A1 of the shield plates 20 of the plug connector 12 are inserted into the slits 50 of the housing 40 of the jack connector 14. Also, the biforked parts B3 of the shield plates 44 of the jack connector 14 hold the rectangular parts A1 of the shield plates 20 of the plug connector 12. Thus, the shield plates 20 and the shield plates 44 are positively connected.

As shown in FIG. 18, in a state where the plug connector 12 and the jack connector 14 are connected, the shield plates 20 and the shield plates 44 are engaged in a grid pattern. A pair of (two) contact parts (one unit) 54, in each of which two contact points 32 are in contact with the contact point 52, are substantially perfectly surrounded by one element defined by the grid pattern. Hence, a pair of the contact parts 54 is positively shielded from the surrounding pairs of the contact parts 54. Thus, crosstalk between adjacent pairs of the contact parts 54 is preferably reduced. Additionally, in this case, it is possible to arrange the contacts with a high density.

The connector apparatus according to this embodiment possesses sufficient shielding effects as described above. Accordingly, it is not always necessary to use a balanced transmission method using one pair of contacts. It is also possible to use a method of transmitting signals using one contact. Hence, compared with conventional connector apparatuses using balanced transmission methods so as to compensate for insufficiency of the shielding effects of shield plates, it is possible to double the rate of mounting density of the contacts.

The present invention is not limited to the specifically disclosed embodiments, and variations and modifications may be made without departing from the scope of the present invention.

The present application is based on Japanese priority application No. 2002-248062 filed on Aug. 28, 2002, the entire contents of which are hereby incorporated by reference.

What is claimed is:

1. A connector apparatus, comprising:

a first connector; and a second connector connected to the first connector, the first connector comprising:

a first connector body, a plurality of first contacts provided in an end face of the first connector body in a matrix-like manner, each of the first contacts having a first contact point, and a plurality of first shield plates, each of the first shield plates being provided between adjacent ones of the first contact points of the first contacts in a row direction, the first shield plates extending in a column direction of the first contact points, and shielding at least the adjacent first contact points in each row, the second connector comprising:

a second connector body, a plurality of second contacts provided in an end face of the second connector body in a matrix-like manner, each of the second contacts having a second contact point, the second contact points making contact with and being electrically connected to the first contact points, and a plurality of second shield plates, each of the second shield plates being provided between adjacent ones of the second contact point of the second contacts in a column direction, the second shield plates extending in a row direction of the second contact points and shielding at least the adjacent second contact points in each column, wherein at least one of the first and second shield plates are formed with slits receiving ends of the other one of the first and second shield plates and the first and second shield plates are configured and arranged to be engaged in a grid pattern by connecting the first and second connectors so that a contact part including one of the first and one of the second contact points is arranged within one element defined by the grid pattern, wherein ends of one of the first and second shield plates are formed into biforked shapes and receive ends of the other one of the first and second shield plates, thereby engaging the first and second shield plates with each other.

2. The connector apparatus as claimed in claim 1, wherein the two first contact points of a pair of the adjacent first contacts in a row form a first unit, and the first connector includes the first shield plates each extending in the column direction and shielding at least the adjacent first units in the row direction, the two second contact points of a pair of the adjacent second contacts in a row form a second unit, and the second connector includes the second shield plates each extending in the row direction and shielding at least the adjacent second units in the column direction, and the first and second shield plates are configured and arranged to be engaged in a grid pattern by connecting the first and second connectors so that two contact parts forming one unit with each unit including one of the first and one of the second contact points are arranged within one element defined by the grid pattern.

3. The connector apparatus as claimed in claim 1, wherein the first and second contact points fit in to and make contact with each other.

4. The connector apparatus as claimed in claim 1, wherein the first and second contact points fit in to and make contact with each other.

5. A connector apparatus comprising:

a first connector; and a second connector connected to the first connector, the first connector comprising:

a first connector body, a plurality of first contacts provided in an end face of the first connector body in a matrix-like manner, each of the first contacts having a first contact point, and a plurality of first shield plates, each of the first shield plates being provided between adjacent ones of the first contact points of the first contacts in a row direction, the first shield plates extending in a column direction of the first contact points, and shielding at least the adjacent first contact points in each row, the second connector comprising:

a second connector body;

a plurality of second contacts provided in an end face of the second connector body in matrix-like manner, each of the second contacts having a second contact point, the second contact points making contact with and being electrically connected to the first contact points; and a plurality of second shield plates, each of the second shield plates being provided between adjacent ones of the second contact points of the second contacts in a column direction, the second shield plates extending in a row direction of the second contact points and shielding at least the adjacent second contact points in each column, wherein at least one of the first and second shield plates are formed with slits receiving ends of the other one of the first and second shield plates, and the first and second shield plates are configured and arranged to be engaged in a grid pattern by connecting the first and second connectors so that a contact part including gone of the first and one of the second contact points is arranged within one element defined by the grid pattern, wherein one of the first and second connectors is provided with a plurality of third contact points in a corresponding one of the first and second contacts, the third contact points protruding from an end face perpendicular to the end face of a corresponding one of the first and second connector bodies, and the other one of the first and second connectors is provided with a plurality of fourth contact points in the other one of the first and second contacts, the fourth contact points protruding from an end face parallel to the end face of the other one of the other one of the first and second connector bodies, and wherein the first and second shield plates are formed to cover the entire first and second contacts each including one of the third and fourth contact points, respectively.

* * * * *